US008584288B2

(12) United States Patent
Shaw

(10) Patent No.: US 8,584,288 B2
(45) Date of Patent: Nov. 19, 2013

(54) MATTRESS EXPANDER

(76) Inventor: Mark Shaw, North Lima, OH (US)

( * ) Notice: Subject to any disclaimer, the term of this patent is extended or adjusted under 35 U.S.C. 154(b) by 241 days.

(21) Appl. No.: 12/897,269

(22) Filed: Oct. 4, 2010

(65) Prior Publication Data

US 2011/0078854 A1 Apr. 7, 2011

Related U.S. Application Data

(60) Provisional application No. 61/248,668, filed on Oct. 5, 2009.

(51) Int. Cl.
*A47C 17/00* (2006.01)

(52) U.S. Cl.
USPC ..... 5/723; 5/722; 5/739

(58) Field of Classification Search
USPC ..... 5/690, 691, 722, 723, 728, 737, 739, 5/496–500, 661, 630, 632, 717, 652, 657, 5/482
See application file for complete search history.

(56) References Cited

U.S. PATENT DOCUMENTS

| | | | | |
|---|---|---|---|---|
| 1,933,342 | A | 10/1933 | Salter | |
| 2,271,601 | A | 2/1942 | Miller | |
| 2,883,683 | A | 4/1959 | Burk | |
| 3,058,126 | A | 10/1962 | Fleming et al. | |
| 3,308,492 | A | 3/1967 | Lovette | |
| 4,271,547 | A | 6/1981 | Grossutti | |
| 5,214,809 | A | 6/1993 | Stuart | |
| 5,701,620 | A | 12/1997 | Montross | |
| 5,724,685 | A | 3/1998 | Weismiller et al. | |
| 5,725,486 | A * | 3/1998 | Engelman | 602/5 |
| 5,745,936 | A | 5/1998 | Van McCutchen et al. | |
| 5,953,779 | A | 9/1999 | Schwartz | |
| 6,047,422 | A | 4/2000 | Yousif | |
| 6,324,709 | B1 | 12/2001 | Ikeda et al. | |
| 6,357,065 | B1 | 3/2002 | Adams | |
| 6,499,167 | B1 | 12/2002 | Ellis et al. | |
| 6,510,571 | B1 | 1/2003 | Tittle et al. | |
| 6,557,198 | B1 | 5/2003 | Gladney et al. | |
| 6,588,035 | B2 | 7/2003 | Le Duc et al. | |
| 7,165,282 | B2 * | 1/2007 | Watson | 5/739 |
| 7,225,489 | B1 | 6/2007 | Frickey et al. | |
| 7,363,668 | B2 * | 4/2008 | Chen | 5/690 |
| 7,520,004 | B2 | 4/2009 | Czop | |
| 8,001,638 | B1 | 8/2011 | Quinter et al. | |
| 2002/0148043 | A1 | 10/2002 | Le Duc et al. | |
| 2003/0028970 | A1 | 2/2003 | Gladney et al. | |

* cited by examiner

*Primary Examiner* — Nicholas Polito
(74) *Attorney, Agent, or Firm* — Shannon V. McCue; Hahn Loeser & Parks LLP

(57) ABSTRACT

A mattress expander used to increase a width of a mattress, the mattress expander including a top pad having a width greater than the mattress to define overhanging portions on either side of the mattress, a pair of side members, under the overhanging portions; and, a mattress extending from one side portion and attachable to the other side portion to hold the side members under respective overhanging portions defining a mattress receiving channel there between.

3 Claims, 6 Drawing Sheets

MATTRESS EXPANDER

RELATED APPLICATION DATA

This application claims priority from provisional application No, 61/248,668, filed on Oct. 5, 2009.

TECHNICAL FIELD

The present invention relates to a mattress expander used in a care-giving environment. The mattress expander is designed to overlie and attach to a standard hospital bed mattress, and provide a wider supporting surface on which a person may lie.

BACKGROUND OF THE INVENTION

Often it is desirable to provide a larger than standard supporting surface for a person to lie on. For example, in a care-giving situation, bariatric patients may require a supporting surface that is wider than a standard hospital bed mattress. In such situations, it is also desirable to provide a seamless supporting surface to reduce the likelihood of irritation and decubitus sores associated with such seams.

SUMMARY OF THE INVENTION

In general, the present invention provides a mattress expander used in connection with a mattress, the mattress expander including a top pad that has a width greater than the mattress forming overhanging portions that extend laterally outward of the mattress; a pair of side members depending downwardly from the top pad and defining a channel there between, the side members extending downward an extent such that a lower surface of the side member is about level with a lower surface of the mattress; a flap extending from each side member and tuckable beneath the mattress to hold the side members against the mattress and beneath respective of the overhanging portions.

The present invention further provides a mattress expander used to increase a width of a mattress, the mattress expander including a top pad extending laterally outward of the mattress on either side to define overhanging portions, a pair of side members, a cover housing the top pad in a top portion and the side members in the side portions, where the side portions of the cover are attached to respective lower lateral outward extremities of the top portion by cover material that forms a hinge between the top pad and the side members; a pair of flaps extending from each side member and attachable to each other to hold the side members under the respective overhanging portions defining a mattress receiving channel there between.

A BRIEF DESCRIPTION OF THE DRAWINGS

DETAILED DESCRIPTION OF THE INVENTION

Figure 1:
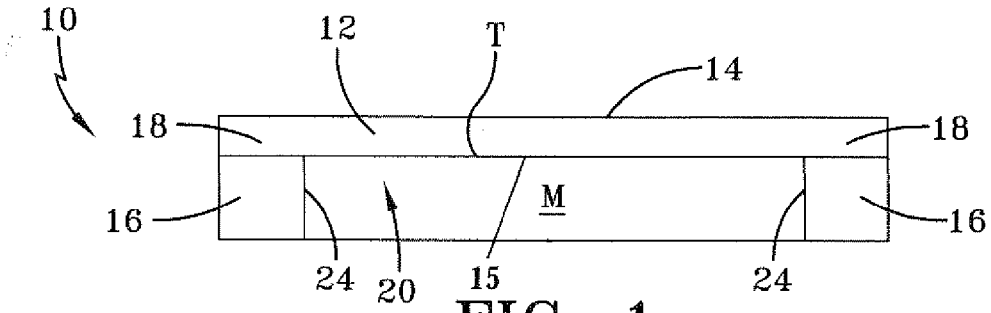
FIG. 1 is an end elevational view of a mattress expander according to the concepts of the present invention shown installed on a mattress.
Figure 2:
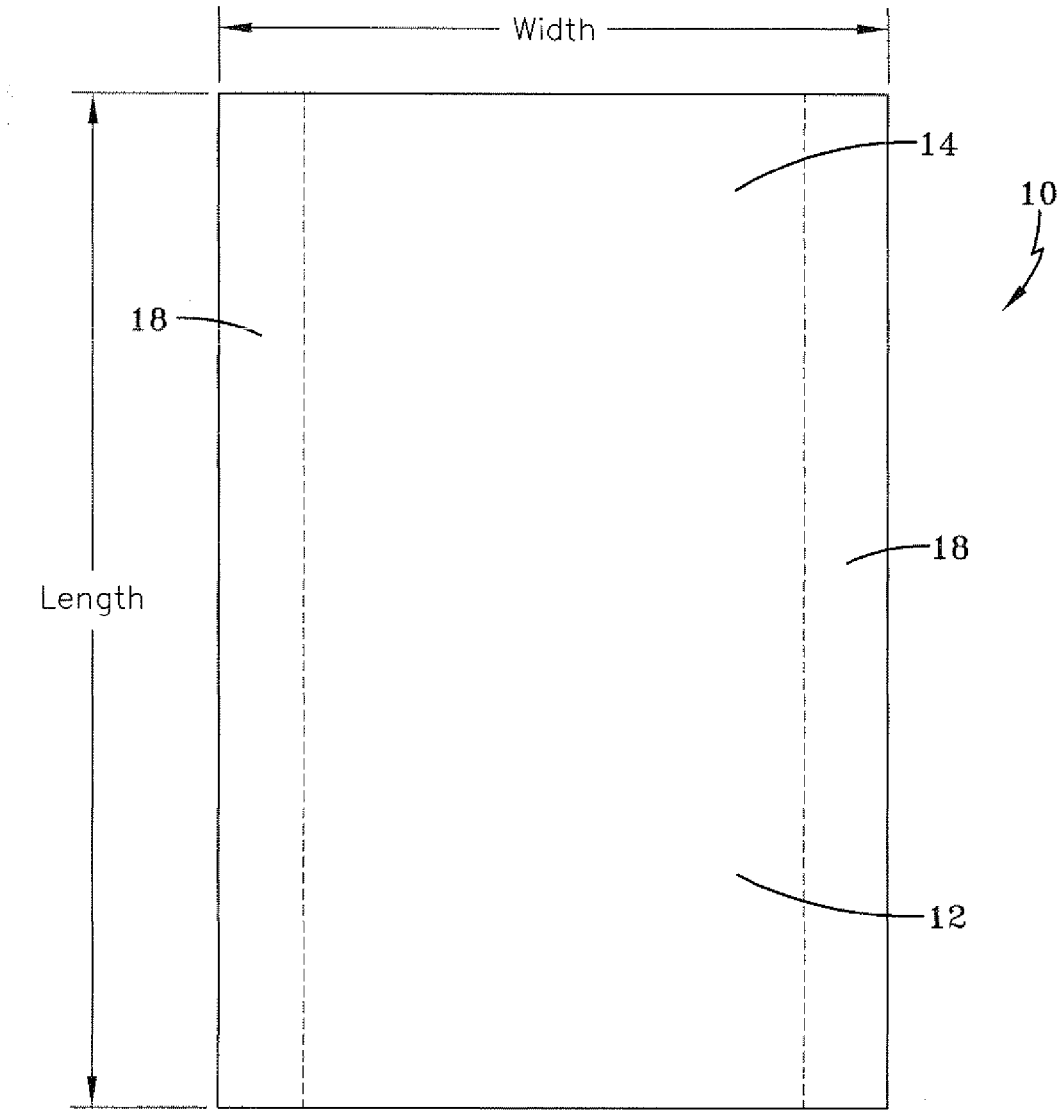
FIG. 2 is a top plan view of a mattress expander according to the concepts of the present invention.

As best shown in FIG. 1, a mattress expander 10 according to the present invention includes a top pad 12 that overlies a top surface T of a standard mattress M. Standard mattresses in care-giving settings typically are 80-84 inches long, 36 inches wide, and 6 inches in height. These dimensions are examples and should not be considered limiting. Top pad 12 is wider than the standard mattress M, i.e. greater than 36 inches wide, and therefore provides a wider supporting surface or top surface 14. Top surface 14 is a constant surface free from seams, folds, or other joints that could create discomfort or lead to decubitus sores. The length of top pad 12 is sized to be the same as or close to the length of the mattress M that is being expanded so that the mattress expander 10 fits between the headboard and footboard of the bed to which the mattress expander 10 is applied. It will be appreciated that greater length could be provided by mattress expander 10 by extending its length. Top pad 12 may be constructed of foam, as shown, or other suitable padding material including natural fiber, open or closed cell foam, synthetic fiber, air or other fluid containing bladders, among others. As shown, top pad 12 may have a constant thickness. As shown, top pad 12 may be a monolithic member. In the example shown, top pad 12 has an uninterrupted lower surface 15 that extends laterally outward of the mattress M to form overhanging portions indicated at 18.

A pair of side members 16 are attached to top pad 12 as described in more detail below. Side members 16 lie below overhanging portions 18 of top pad 12 that extend laterally outward of mattress M. Side members 16 have a height similar to that of standard mattress M and may extend below the lower surface L of mattress M, as necessary. Side members 16 generally have the same lateral dimension as the overhanging portions 18 of top pad 12, and extend longitudinally to the same extent as top pad 12. It will be appreciated, however, that side members 16 do not have to have the same length and width as the top pad 12 and do not have to have the same width as overhanging portions 18. For example, the lateral and longitudinal dimensions of side members 16 may be smaller or larger than overhanging portions 18 of top pad 12. The material used to construct the side members 16 may be selected from the same types of padding materials used to construct top pad 12, but may not necessarily be the same material as top pad 12. For example, to provide additional support under overhanging portions 18 of top pad 12, a more dense material may be used to construct side members 16. While, in the example shown, side members 16 are separate from top pad 12, the top pad 12 and side members 16 may be constructed as a unitary member or monolithic member.

As shown, side members 16 extend downward relative to top pad 12 and are laterally spaced from each other to define a mattress receiving channel 20 between the interior surfaces 24 of each side member 16. The channel 20 has lateral and longitudinal dimensions that conform closely to a standard mattress M. In the example shown, channel 20 has a width of about 36 inches. Channel 20 may be slightly smaller than the width of the mattress M to create an interference fit between the side members 16 and mattress M. In the example shown, side members 16 are held against the mattress M and under overhanging portions 18 by a flap that may be tucked beneath the mattress M on either side. As described more completely below, opposing flaps or a single flap may be used to connect side members 16 to each other.

Figure 3:
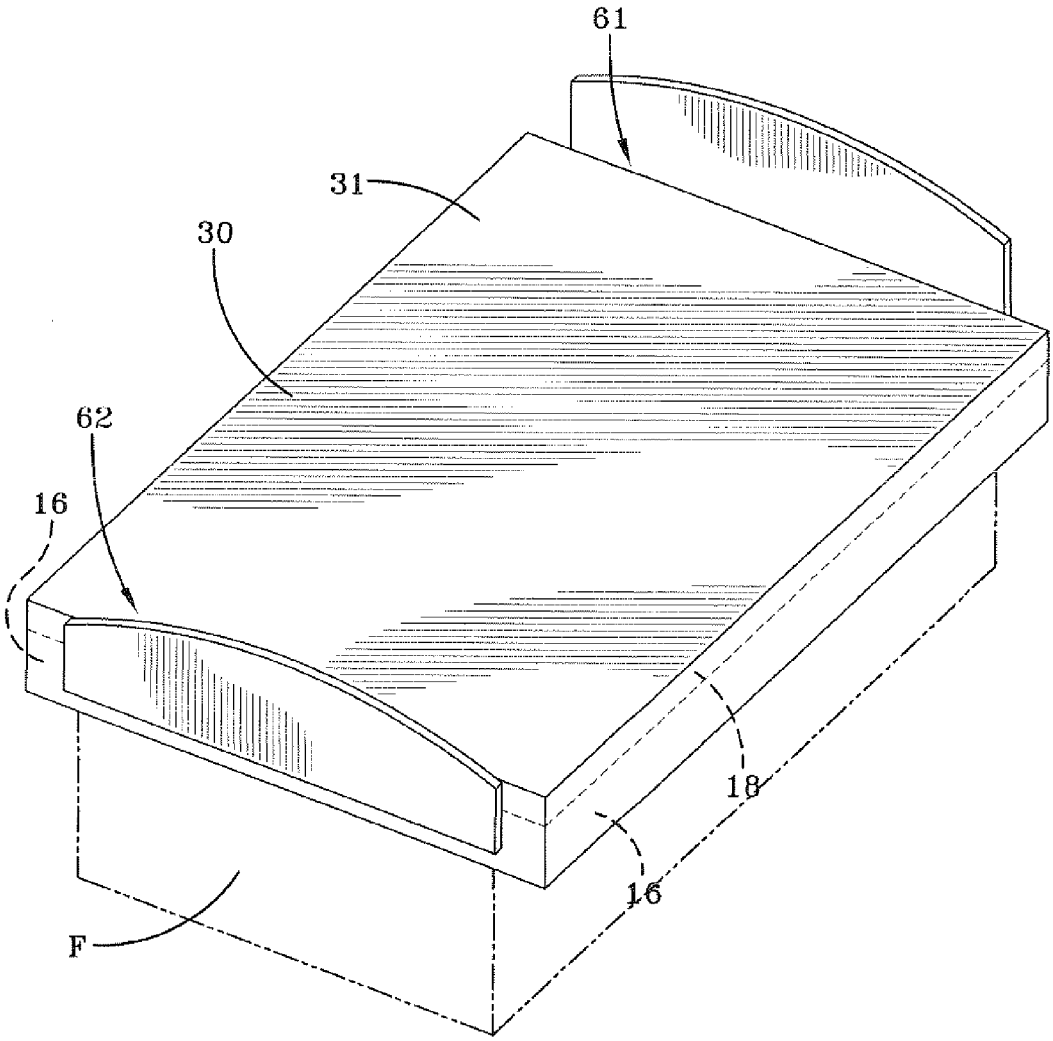
FIG. 3 is a partially schematic perspective view of a mattress expander according to the concepts of the present invention housed within a cover and installed on a mattress supported on a standard hospital bed frame.
Figure 5:
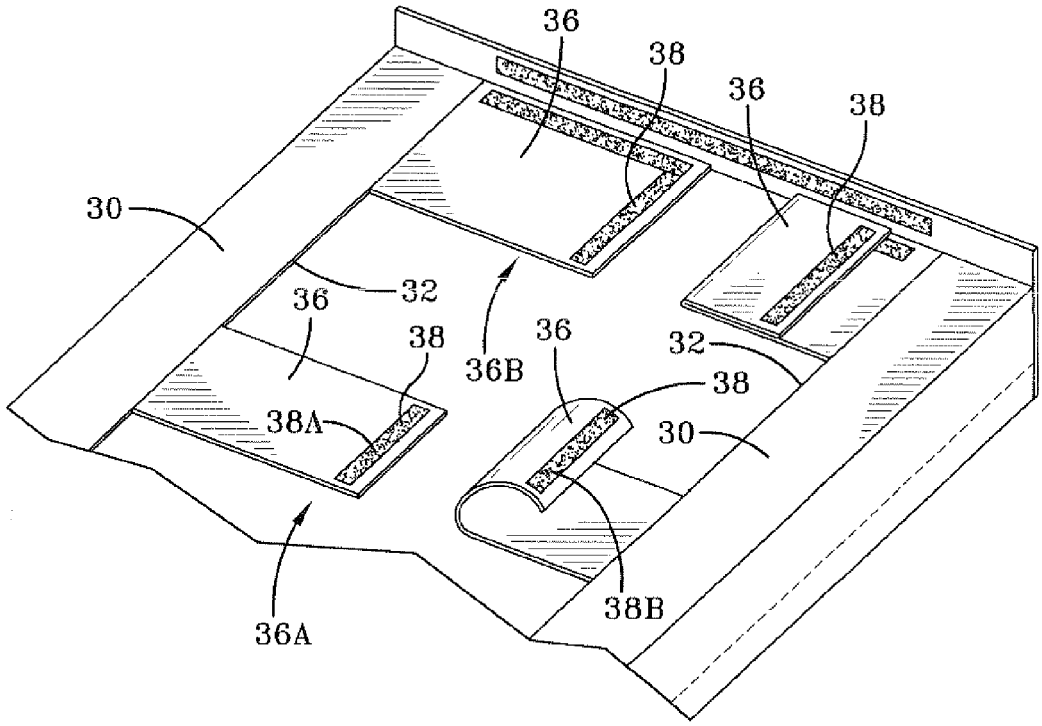
FIG. 5 is a partially fragmented enlarged perspective view of one end of a mattress expander according to the concepts of the present invention housed in a cover showing further details of the mattress flaps used to attach the mattress expander to the mattress.
Figure 6:
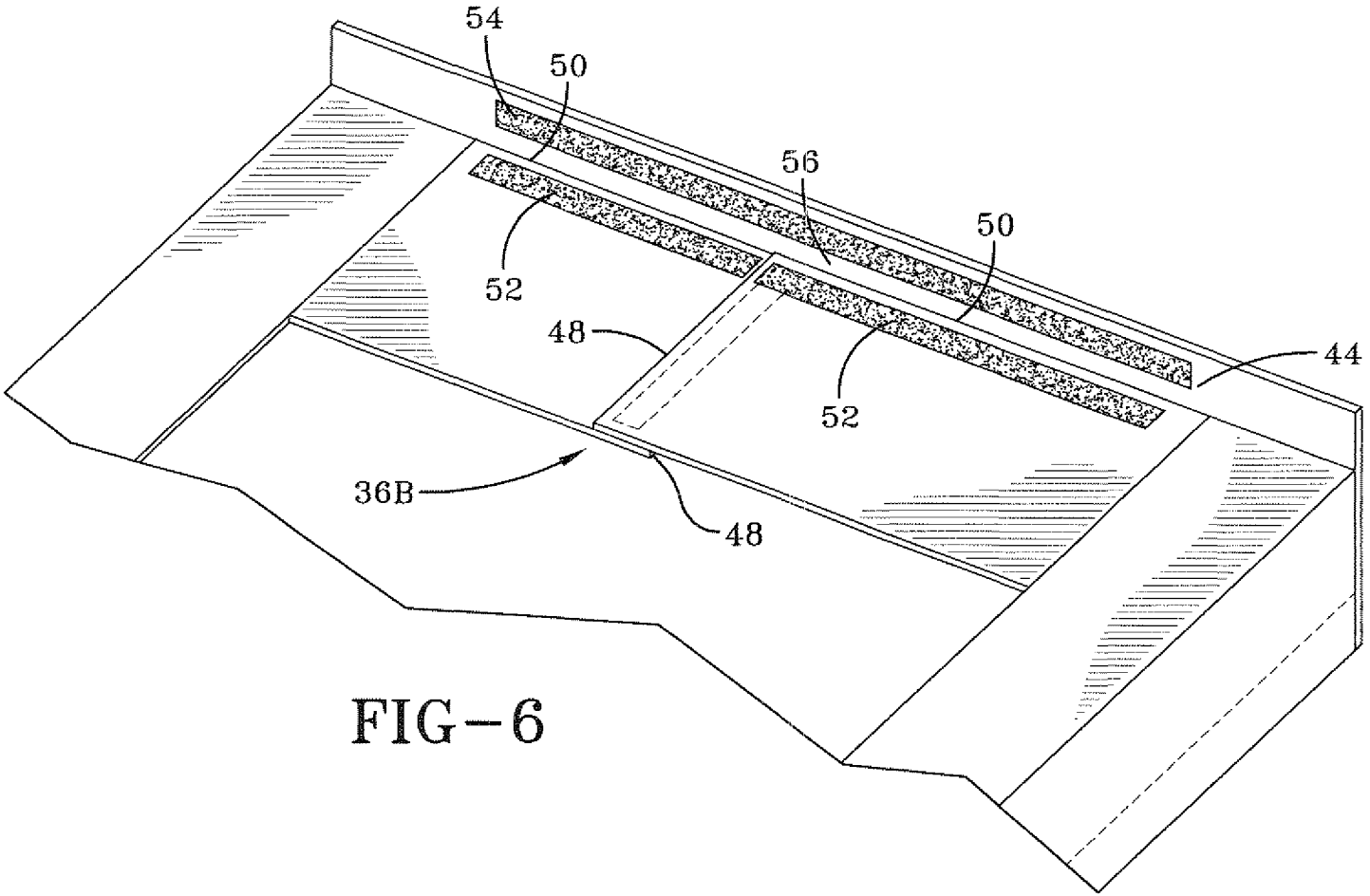
FIG. 6 is a partially fragmented perspective few similar to FIG. 5 showing details of an end portion of the mattress expander cover including an end flap that attaches to the mattress flaps to cover an end of the mattress.
Figure 7:
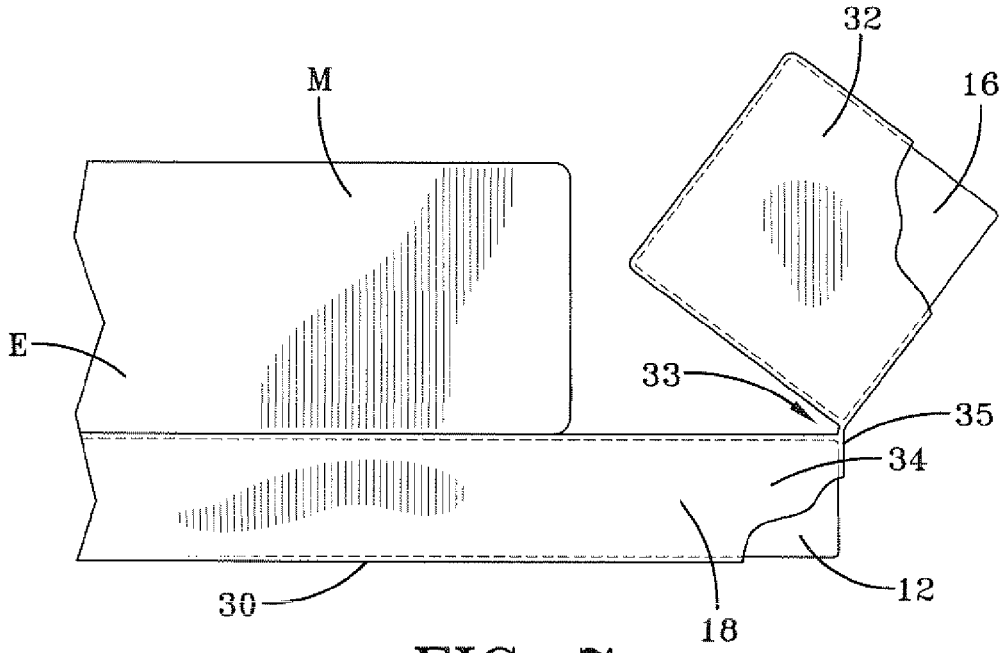
FIG. 7 is a partially fragmented partially cut away enlarged end elevational view of a mattress expander and cover according to the concepts of the present invention inverted to show details of the positioning of side members of the mattress expander relative to the mattress.
Figure 8:
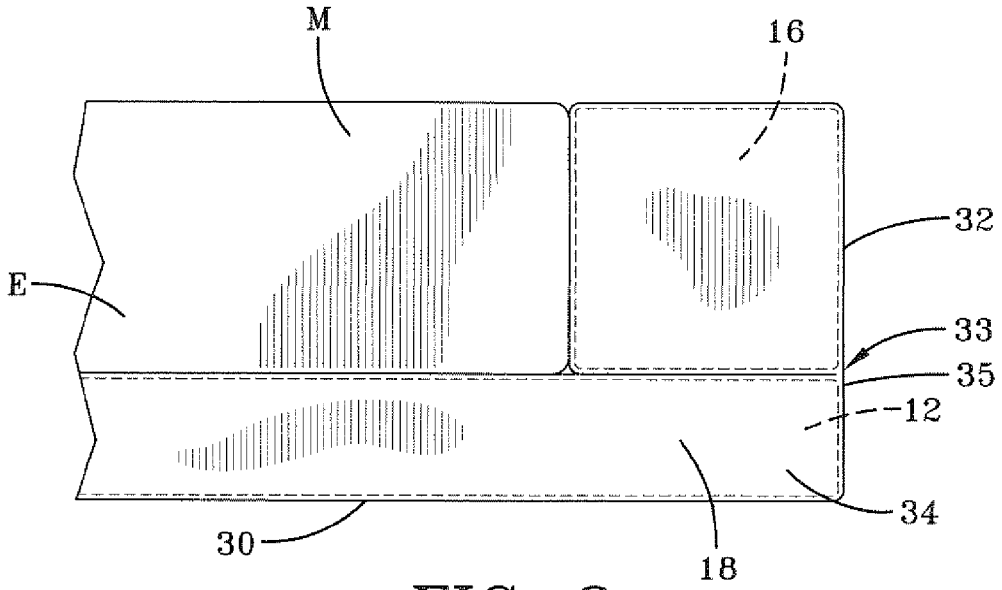
FIG. 8 is a partially fragmented end elevational view similar to FIG. 7 shown inverted to show details of placement of the side members of the mattress expander against the mattress in the fully installed position.

As best shown in FIGS. 3-8, a cover 30 fits over top pad 12 and side members 16 and may be used to attach top pad 12 and side members 16 to mattress M, as discussed more below. As best shown in FIG. 3, cover 30 may have a seamless top surface 31 that overlies top pad 12 such that the expanded top surface of mattress expander 10 has no seams. As best shown in FIG. 7, cover 30 may encompass top pad 12 and side members 16 individually such that each pad is housed within its own covering. Alternatively, a single cover may house all of the pads. As shown in FIG. 7, cover 30 may be used to attach top member 12 to side members 16. In particular, cover 30 may include a top portion 34 that envelopes the top pad 12 and side portions 32 (one shown) that extend downward from the top portion 34 of cover 30. The side portions 32 may be sewn to or otherwise attached to the side 35 of top portion 34 of cover 30. In the embodiment shown, side portions 32 extend downward from the underside of top portion 34 of cover 30 surrounding top pad 12 forming a hinge-like connection 33 between top pad 12 and side members 16. This hinge-like connection 33 may facilitate positioning of mattress expander 10 in relation to mattress M.

As best shown in FIG. 3, since the standard bed frame F is only the width of the standard mattress M, side members 16 may be unsupported. To that end, side members 16 may be attached to each other or secured by a flap that extends under the mattress such that the weight of the mattress M holds the side members 16 in place. To that end, a mattress flap 36 may be operatively attached to one or more side members 16 and tuckable beneath mattress M. Alternatively, the mattress flap 36 may extend from one side member and attach to another portion of mattress expander 10, for example, an opposite side member 16, to secure the side members beneath the overhanging portions 18 of top pad 12. In the example shown, since top pad 12 and side members 16 are housed within a cover, operative attachment of mattress flap 36 may be achieved by attaching a mattress flap 36 to a portion of the cover 30. For example, with reference to FIGS. 4-6, one or more mattress flaps 36 may extend inward from one or more of side portions 32 of cover 30 to extend beneath mattress M. In the embodiment shown in FIG. 4, a pair of mattress flaps 36 extends inward from opposite side portions 32 of cover 30 and attach to each other beneath mattress M. Mattress flap 36 may be any member that can be tucked or otherwise extended under the mattress M to help secure the mattress expander 10. The mattress flaps 36 do not need to attach to each other and may rely on the weight of the mattress M to secure mattress expander 10. As depicted, to provide further security, first and second mattress flaps 36 may attach to each other, another portion of mattress expander 10 to cover 30. To that end mattress flaps 36 may include members that attach to each other such as belts, ties, straps, or include a fastener to attach the members together. Attachment of mattress flaps 36 to each other may be accomplished with any fastener 38 including but not limited to ties, buckles, toggles, snaps, clips, D-loops, buttons and hook and loop fasteners. For example, hook and loop fastener strips attached to the respective mattress flaps 36 may be used as shown in the depicted embodiment. As shown in FIG. 5, mating hook and loop fastener strips 38A, 38B are provided on flaps 36 and are located to overlap each other when the mattress flaps 36 are extended beneath a mattress M. To account for variations on mattress M, strips 38A, 38B may have an appreciable width. For example, a width greater than 1 cm may be used. The strips 38A, 38B shown have a width of approximately 5-10 cm.

Mattress flaps 36 may be located anywhere along the length of mattress expander 10 and multiple flaps 36 may be used. It will be appreciated that a single flap 36 extending between side members 16 may be used to secure mattress expander 10 or opposing flap pairs, as shown, may be used. In the example shown in FIG. 4, a first pair of mattress flaps 36A are located centrally along the longitudinal axis of mattress expander 10. A second pair of mattress flaps 36B are located at one end of mattress expander 10, and a third pair of mattress flaps 36C are located at the opposite end of mattress expander 10. Each mattress flaps may have a different shape or construction. In the example shown, each pair of mattress flaps has a similar shape and construction, and therefore the description of the mattress flaps 36 will apply generically to each of the mattress flap pairs 36*a*, 36B, 36C. Differences between the individual pairs will be noted.

The mattress flaps 36 may have any width that facilitates attachment to secure mattress expander 10 such that side members 16 are held in a supporting relationship to overhanging portions 18. In terms of longitudinal dimension, mattress flaps 36 may have any dimension. In the example shown, the longitudinal dimension of mattress flaps 36 is greater than 10 cm, and may be about 30 cm.

Figure 4:
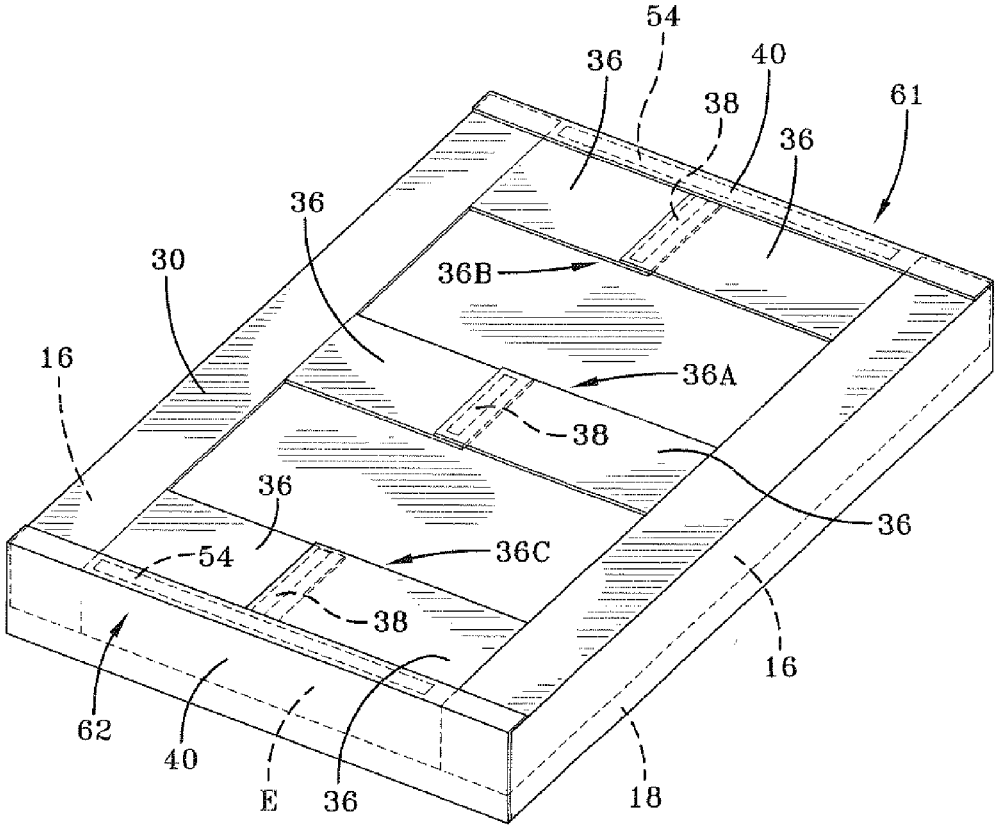
FIG. 4 is a bottom perspective view of a mattress expander according to the concepts of the present invention housed in a cover and installed on a mattress showing details of mattress flaps used to attach a mattress expander to the mattress.

As shown in FIGS. 4-6, cover 30 may further include end portions, generally indicated by the number 40. End portions 40 generally include one or more end flaps 44, that wrap around one of the ends E of mattress M to further secure mattress expander 10. In the example shown, end portions 40 work with the second and third pairs of mattress flaps 36B, 36C that extend inward from the sides of the longitudinal ends of cover 30 (FIGS. 4-6) to underlie a portion of the end E of mattress M. An end flap 44 extends downward from each end of cover 30 covering a longitudinal edge (i.e., the head or foot) of mattress M. End flap 44 is fastened to flaps 36, as by a hook and loop or other suitable fastener as discussed with respect to flaps 36 above.

In the example shown in FIG. 6, lateral edges 48 of mattress flaps 36 are provided with hook and loop fasteners to attach the mattress flaps 36 to each other. Longitudinal edges 50 of mattress flaps 42 have hook fasteners 52 on their outward facing surface that engage loop fasteners 54 provided on the inward facing surface 56 of end flap 44. In this way mattress flaps 36 and end flap 44 join together to form a cap-like end portion 40 at end E of mattress M. In the embodiment shown, end portions 40 at either end of mattress expander 10 are constructed in the same manner, and therefore the same reference numbers are used to refer to the structures at the head portion 61 and foot portion 62 of mattress expander 10 (FIGS. 3 and 4D).

Cover 30, mattress flaps 36, and end portions 40 may be constructed of any natural or synthetic fiber. In the example shown, a fluid resistant or fluid proof material is used to protect the underlying foam and/or mattress M.

As best shown in FIG. 4, when attached, cover 30 holds side members 16 against the outer walls of mattress M placing side members 16 in supporting relation to overhanging portions 18 of top pad 12 and securing mattress expander 10 to mattress M. In this configuration, top pad 12 provides a seamless supporting surface that is wider than the underlying mattress M. With the end portions 40 of cover 30 attached, mattress expander 10 encapsulates mattress M providing greater security and allowing cover 30 to fully protect mattress M from fluids.

A new and useful mattress expander according to the concepts of the present invention has been shown and described herein. The above description describes various embodiments of the invention as examples and is not limiting. For an appreciation of the scope of the invention, reference should be made to the following claims.

What is claimed:

1. A mattress expander used to increase a width of a mattress, the mattress expander comprising:

a top pad extending laterally outward of the mattress to define overhanging portions on either side of the mattress;

a pair of side members;

a cover housing said top pad in a top portion and said side members in side portions, wherein said side portions are each attached to a lateral outward extremity of said top portion;

a first mattress flap attached to at least one side portion and attachable to the other side portion to hold said side members under respective overhanging portions defining a mattress receiving channel there between;

a pair of end flaps extending from longitudinal extremities of said cover, said end flaps extending downwardly an extent such that said end flaps are tuckable beneath said mattress; and two pairs of mattress flaps extending from said side portions at a lower extremity thereof, wherein one pair of mattress flaps is located at a first longitudinal extremity of said side portion and the other pair of mattress flaps is located at an opposite longitudinal extremity of said side portions, wherein said pairs of mattress flaps are attachable to each other and respective end flaps to form an end portion at each end of said cover adapted to receive an end of the mattress therein.

2. The mattress expander of claim 1, wherein each of said end flaps includes a hook and loop fastener extending laterally along said end flap and attachable to a corresponding hook and loop fastener on said mattress flaps forming said pairs of mattress flaps; and where said mattress flaps each contain a hook and loop fastener extending longitudinally thereon and engagable with a corresponding hook and loop fastener on the opposite mattress flap to attach said pair of mattress flaps to each other.

3. A mattress expander comprising:

a top pad having a seamless top surface, said top pad having a width greater than 36 inches defining overhanging portions at lateral outward extensions of said top pad;

a first side member and second side member located beneath said overhanging portions of said top pad and extending along longitudinal edges of said top pad defining a mattress receiving channel beneath said top pad, wherein said side members are attached to said top pad; wherein said top pad is constructed of a padding material;

wherein said side members each have a lower surface and wherein said lower surface of each side member is attached to the other by a mattress flap;

a second mattress flap extending opposite said mattress flap, wherein said mattress flap and said second mattress flap extending opposite said mattress flap, wherein said mattress flap and said second mattress flap attach to each other to attach each side member, said mattress flap and said second mattress flap forming a first pair of mattress flaps that are longitudinally centered relative to said top pad;

a second pair of mattress flaps extending from said side members at a head portion of said side members, and a third pair of mattress flaps extending from a foot portion of said side members, wherein said first, second, and third pairs of mattress flaps attach to each other with a hook and loop fastener;

and a first end flap extending downward from said top pad below said side members and attachable to said second pair of mattress flaps to form a first end portion, and a second end flap extending downward from a opposite end of said top pad below said side members and attachable to said third pair of mattress flaps to form a second end portion, wherein said first and second end flaps attach to respective second and third pairs of mattress flaps by a hook and loop fastener.

* * * * *